US005725961A

United States Patent [19]

Ozawa et al.

[11] Patent Number: 5,725,961

[45] Date of Patent: Mar. 10, 1998

[54] RECORDING MEDIUM HAVING INK-ABSORBENT LAYER

[75] Inventors: Yoshiyuki Ozawa; Hideo Yamazaki, both of Suwa; Kenji Kawada; Tetsuya Ochiai, both of Yokohama, all of Japan

[73] Assignees: Seiko Epson Corp.; Taiho Industries Co., Ltd., both of Tokyo-to, Japan

[21] Appl. No.: 720,772

[22] Filed: Oct. 3, 1996

[30] Foreign Application Priority Data

Oct. 6, 1995 [JP] Japan ..... 7-260215

[51] Int. Cl.[6] ..... B41M 5/00

[52] U.S. Cl. ..... 428/500; 347/105; 428/195; 428/336

[58] Field of Search ..... 428/500, 195, 428/336; 347/105

[56] References Cited

FOREIGN PATENT DOCUMENTS

| | | |
|---|---|---|
| 0233703 | 8/1987 | European Pat. Off. . |
| 51-37017 | 10/1976 | Japan . |
| 55-42744 | 11/1980 | Japan . |
| 56-58869 | 5/1981 | Japan . |
| 58-24493 | 2/1983 | Japan . |
| 58-89391 | 5/1983 | Japan . |
| 61-18818 | 1/1986 | Japan . |
| 61-188181 | 8/1986 | Japan . |
| 62-12278 | 1/1987 | Japan . |
| 62-1426 | 1/1987 | Japan . |
| 62-122781 | 6/1987 | Japan . |
| 356573 | 3/1991 | Japan . |
| 379678 | 4/1991 | Japan . |
| 3160068 | 7/1991 | Japan . |
| 418462 | 1/1992 | Japan . |

OTHER PUBLICATIONS

Patent Abstracts of Japan, vol. 11, No. 344 (M-640), Nov. 11, 1987.

Patent Abstracts of Japan, vol. 11, No. 14 (M553), Jan. 14, 1987.

Patent Abstracts of Japan, Publication of May, 1981, No. 56058869A for Pat. Appln 54134432.

Patent Abstracts of Japan, Publication No. 58024493A of Feb. 1983 for Pat. Appln 56123321.

Patent Abstracts of Japan, Publication No. 58089391A of May, 1983 for Pat. Appln. 56187499.

Patent Abstracts of Japan, Publication No. 03056573A of Mar. 1991 for Pat. Appln. 01192246.

Patent Abstracts of Japan, Publication No. 03079678A of Apr. 1991 for Pat. Appln. 01215739.

Patent Abstracts of Japan, Publication No. 03160068A of Jul. 1991 for Pat. Appln. 01299233.

Patent Abstracts of Japan, Publication No. 61188181A of Aug. 1986 for Pat. Appln. 60026333.

Patent Abstracts of Japan, Publication No. 62122781A of Jun. 1987 for Pat. Appln 60262561.

Patent Abstracts of Japan, Publication No. 56028256A of Mar. 1981 for Pat. Appln. 54104741.

Patent Abstracts of Japan, Publication No. 04018462A of Jan. 1992 for Pat. Appln. 02122032.

*Primary Examiner*—Pamela R. Schwartz
*Attorney, Agent, or Firm*—Ladas & Parry

[57] ABSTRACT

A recording medium is provided which causes none of bleeding or feathering, cracking and whitening of a print and is suitably usable especially for ink jet recording. The recording medium, when used in a system where an image is viewed by taking advantage of transmitted light, such as a system using an OHP sheet, can realize a good image having high light transmittance and high brightness. The recording medium comprises a substrate bearing an ink-absorbent layer, the ink-absorbent layer being formed of a polymer complex of a basic polymer and a styrene/(meth) acrylic acid polymer, the mixing ratio of the basic polymer and the styrene/(meth)acrylic acid polymer being in the range of from 10:3.5 to 7.

11 Claims, 1 Drawing Sheet

RECORDING MEDIUM HAVING INK-ABSORBENT LAYER

BACKGROUND OF THE INVENTION

1. Field of the Invention

The present invention relates to a recording medium for recording using an ink composition. More particularly, the present invention relates to a recording medium suitable for ink jet recording.

2. Background Art

In order to realize an image having a high quality, various properties are required of a recording medium used in a recording system in which an ink composition is employed. Examples of properties required of the recording medium include: that an ink composition causes none of image feathering, color-to-color bleeding, and flow of the ink; that the deposited ink composition can be rapidly absorbed into the recording medium or dried; that the end portion of the recording medium is less likely to be raised, i.e., to cause the so-called "curling;" that the print can be maintained without deterioration for a long period of time; and that the surface of the image has a gloss and a texture. For recording media used in ink jet recording, further requirements to be satisfied include circular ink dots and sharp periphery of dots without bleeding or feathering.

Further, when a multicolor image is formed, further requirements to be satisfied include that the coloring of the colorant of the ink composition is good and that overprinting of a plurality of ink compositions cause no flow of ink on the recording medium.

In recent years, in addition to a recording system where a printed record is viewed by taking advantage of light reflected from the surface of the record, a recording system where a printed record is viewed by taking advantage of transmitted light, such as a slide or an overhead projector (OHP) has become extensively used in the art. Therefore, recording media in which a recorded image is viewed through transmitted light should also satisfy the above properties required when the image is formed by an ink composition. In addition, since an image is viewed through transmitted light, it should be bright, i.e., has high light transmittance.

In order to satisfy such various property requirements, ink-absorbent layers on a substrate have been proposed in the art. For example, a recording medium comprising a porous layer as an ink-absorbent layer and a recording medium comprising a water-soluble polymer as an ink-absorbent layer coated on the surface thereof have been proposed. More specific examples thereof include various recording media described in Japanese Patent Laid-Open Nos. 122781/1987, 58869/1981, 24493/1983, 89391/1983, and 188181/1986.

In particular, Japanese Patent Laid-Open No. 122781/1987 describes a recording medium having an ink-absorbent layer formed of a polymer complex of a basic polymer and the above styrene/(meth)acrylic acid polymer. This publication describes that no recording medium having good properties can be provided unless the mixing ratio of the basic polymer to the styrene/(meth)acrylic acid polymer is in the range of 10:1 to 3.

SUMMARY OF THE INVENTION

We have now found that the mixing ratio range which is described, in Japanese Patent Laid-Open No. 122781/1987, not to provide good properties can unexpectedly provide an excellent recording medium. We have also found that a combination of a specific ink composition with ink jet recording can realize an excellent image. The present invention has been made based on such findings.

Accordingly, an object of the present invention is to provide a recording medium having good properties, especially a recording medium suitable for ink jet recording.

Another object of the present invention is to provide a recording medium, having good properties suitable for a system where an image is viewed through transmitted light, such as an OHP sheet.

A further object of the present invention is to provide an ink jet recording method which can realize a good image.

Thus, according to one aspect of the present invention, there is provided a recording medium comprising a substrate and an ink-absorbent layer provided on at least one side of the substrate, the ink-absorbent layer being formed of a polymer complex of a basic polymer and a styrene/(meth) acrylic acid polymer, the mixing ratio of the basic polymer and the styrene/(meth)acrylic acid polymer being in the range of from 10:3.5 to 7.

According to another aspect of the present invention, there is provided an ink jet recording method comprising the steps of: ejecting droplets of an ink composition comprising at least a colorant, a thermoplastic resin, and water onto the recording medium of the present invention to deposit the ink droplets onto the recording medium; and heating the recording medium with the ink droplets deposited thereonto.

PREFERRED EMBODIMENTS OF THE INVENTION

Recording medium

Figure 1:
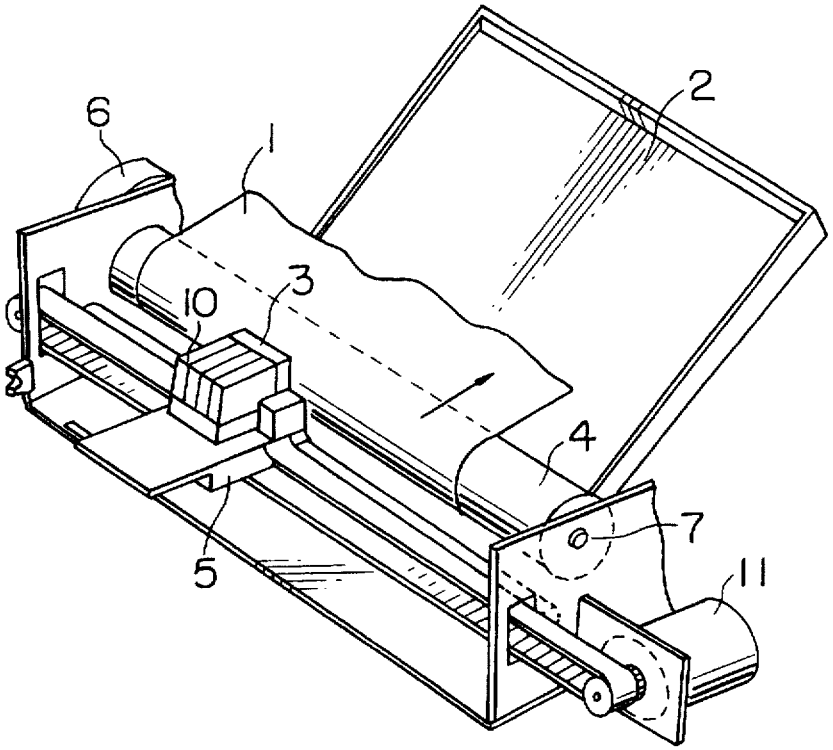
FIG. 1 shows an ink jet recording apparatus suitable for in ink jet recording method using the recording medium according to the present invention and involving the step of heating the recording medium.

The recording medium according to the present invention has an ink-absorbent layer containing a polymer complex. The polymer complex comprises a polymer complex of a basic polymer and a styrene/(meth)acrylic acid polymer, wherein the mixing ratio of the basic polymer to the styrene/(meth)acrylic acid polymer (P/S ratio) is in the range of from 10:3.5 to 7, preferably in the range of from 10:3.5 to 4.5, most preferably in the range of from 10:4 to 4.5.

The P/S value which falls within the above range can effectively prevent cracks in the print. In the case of an recorded image viewed through reflected light, cracks in the print deteriorates the image quality. Furthermore, in the case of an OHP sheet wherein an image is viewed through transmitted light, cracks scatter transmitted light, resulting in darkened projected image. Because of the reduced cracks in the print, the recording medium of the present invention is advantageous in that a high image quality can be realized and, in addition, in the case of OHP sheets and the like, can realize a bright image.

Further, it has been unexpectedly found that the recording medium having a P/S value falling within the above range can prevent whitening of the surface of the print. Although the following description is a hypothesis which is not intended to limit the present invention, it is believed that whitening of the print is caused by an organic solvent which oozes out on the surface of the print. The recording medium of the present invention is considered to effectively prevent the organic solvent component from oozing out on the surface of the print. Whitening deteriorates the image quality of a recorded image viewed through reflected light. Furthermore, in the case of an OHP sheet wherein an image is viewed through transmitted light, whitening scatters transmitted light and, as with the cracks, darkens the projected image. Therefore, the recording medium according to the present invention is advantageous in that a high image quality can be realized and, in the case of an OHP sheet and the like, a bright image can be realized.

As described above, according to the recording medium of the present invention, an image having a high quality can be particularly advantageously realized in a system wherein an image is viewed through transmitted light, such as a system using an OHP sheet. The haze defined as the proportion of scattered light in the total transmitted light may be an index of the brightness of an image viewed through the transmitted light. According to a preferred embodiment of the present invention, the present invention can realize an image having a haze of not more than 20, more preferably not more than 15, most preferably not more than 10.

According to the present invention, the ink-absorbent layer may be formed on at least one side, preferably on both sides of the substrate. The presence of the ink-absorbent layer on both sides of the substrate is preferred because it can effectively prevent curling of the recording medium. The thickness of the ink-absorbent layer of the recording medium according to the present invention is, in some cases, relatively large depending upon the type of selected basic resin or styrene/(meth)acrylic acid polymer. The presence of such an ink-absorbent layer on only one side of the substrate is likely to cause a fear that the ends of the recording medium are raised resulting in curled recording medium. The ink-absorbent layers on both sides of the substrate may effectively prevent curling of the recording medium. The ink-absorbent layers provided on both sides of the substrate are preferably identical to each other. However, they need not be always identical to each other. The composition and the thickness of the ink-absorbent layer provided on the surface of the substrate on which an ink composition is not applied may be determined by considering the way of carrying of the recording medium in a printer, acceptable degree of curling and the like. Presence of an identical ink-absorbent layer on both sides of the substrate is advantageous in that a user of the recording medium need not be sensitive to which is a front or back surface.

Further, the recording medium according to the present invention satisfies various properties which are generally required for recording media. For example, the recording medium according to the present invention can provide an image having excellent properties including high color density, no significant color-to-color mixing, and no significant feathering. Further, the recording medium according to the present invention is advantageous also in that the adhesion of the ink-absorbent layer to the substrate and the carriability in a printer are excellent. In addition, a scratch attributable to carrying of the recording medium is less likely to be formed. Additional advantages of the recording medium according to the present invention include excellent blocking resistance, water resistance, light fastness, storage stability of the image (i.e., the image causes no significant fading and, when placed in a clear plastic bag, does not adhere to the bag), and nontoxicity to the human body. Furthermore, the recording medium of the present invention in the form of a transparent recording medium such as an OHP film has excellent light transmittance.

Specific examples of basic polymers usable in the present invention include:

homopolymers of monomers, such as N-vinyl pyrrolidone, N-vinyl-3-methyl pyrrolidone, N-vinyl-5-methyl pyrrolidone, N-vinyl-3,3,5-trimethyl pyrrolidone, N-vinyl-3-benzyl pyrrolidone, N-vinyl piperidone, N-vinyl-4-methyl piperidone, N-vinyl-caprolactam, N-vinylcapryllactam, N-vinyl-3-morpholine, N-vinylthiopyrrolidone, and N-vinyl-2-pyrrolidone, or random copolymers, block copolymers, graft copolymers and other copolymers of the above monomers with other conventional monomers;

homopolymers of monomers, such as N-vinyl-2-oxazolidone, N-vinyl-5-methyl-2-oxazolidone, N-vinyl-5-ethyl-2-oxazolidone, N-vinyl-4-methyl-2-oxazolidone, N-vinyl-2-thiooxazolidone, and N-vinyl-2-mercaptobenzothiazole, or random copolymers, block copolymers, graft copolymers and other copolymers of the above monomers with other conventional monomers;

homopolymers of monomers, such as N-vinylimidazole, N-vinyl-2-methylimidazole, and N-vinyl-4-methylimidazole, or random copolymers, block copolymers, graft copolymers and other copolymers of the above monomers with other conventional monomers; and homopolymers of monomers, such as 2- or 4-vinylpyridine, or random copolymers, block copolymers, graft copolymers and other copolymers of the above monomers with other conventional monomers. Specific examples of conventional monomers usable herein include homopolymers, copolymers and the like of methacrylate, acrylate, acrylamide, acrylonitrile, vinyl ether, vinyl acetate, vinylimidazole, ethylene, styrene-N-vinyl pyrrolidone, N-vinylpiperidone, N-vinylcaprolactam, N-vinylmorpholine, N-vinyl-2-oxazolidone, and N-vinyl-5-methyl-2-oxazolidone, and preferred are homopolymers and copolymers of N-vinyl pyrrolidone, N-vinylpiperidone, N-vinylcaprolactam, N-vinylmorpholine, N-vinyl-2-oxazolidone, N-vinyl-5-methyl-2-oxazolidone. In the case of copolymers, not less than 50 mol % of the above nitrogen-containing monomer is contained.

In the present invention, preferred basic polymers include polyvinyl pyrrolidones, particularly those which are prepared by polymerizing N-vinyl-2-pyrrolidone prepared by the Reppe reaction and have an average molecular weight of preferably not less than 10,000, more preferably not less than 160,000. Further examples of basic polymers usable herein include homopolymers of monomers, such as N-vinyl pyrrolidone, N-vinyl-3-methyl pyrrolidone, N-vinyl-5-methyl pyrrolidone, N-vinyl-3,3,5-trimethyl pyrrolidone, N-vinyl-3-benzyl pyrrolidone, N-vinylpiperidone, N-vinyl-4-methylpiperidone, N-vinylcaprolactam, N-vinylcapryllactam, N-vinyl-3-morpholine, N-vinylthiopyrrolidone, and N-vinyl-2-pyrrolidone, or random copolymers, block copolymers, graft copolymers and other copolymers of the above monomers with other conventional monomers. The average molecular weight of the above basic polymer is preferably not less than 1,000, more preferably not less than 2,000.

Specific examples of preferred styrene/(meth)acrylic acid copolymers usable herein include a copolymer of styrene or a styrene derivative with acrylic acid or methacrylic acid. The copolymer may be a terpolymer containing a third monomer. Styrene derivatives usable herein include styrene and, further, styrene derivatives such as methylstyrene, dimethylstyrene, trimethylstyrene, α-chlorostyrene, and α-methylstyrene. Olefins, such as ethylene, propylene, and butylene, vinyl halides, such as vinyl chloride and vinyl fluoride, vinyl esters, such as vinyl acetate, (meth)acrylic esters, such as esters of alcohols with (meth)acrylic acid, and other monomers copolymerizable with styrene and (meth) acrylic acid, may be usable as the third monomer. Copolymerization methods are not particularly limited, and copolymers having various comonomer ratios are commercially available and may be used in the present invention.

In the present invention, the comonomer ratio, that is, the molar ratio of styrene to (meth)acrylic acid copolymer is preferably 1:2 to 10:1, more preferably 1:1 to 5:1. In the case of the terpolymer, the third monomer may be contained in an amount up to about 50 mol % based on the total amount of the monomers.

Styrene/(meth)acrylic acid copolymers having various molecular weights are commercially available and may be used in the present invention.

In the present invention, the average molecular weight of the styrene/(meth)acrylic acid copolymer is preferably not less than 1,000, more preferably not less than 5,000.

Use of the polymer having the above molecular weight results in an ink-absorbent layer having good strength of the ink-absorbent layer, ink receptivity, sharpness of the image, water resistance, ink resistance, and blocking resistance.

The polymer complex used in the present invention is a mixture of the above polymers. The polymer complex may be prepared by a conventional method, and examples of the conventional method include those described in Japanese Patent Publication Nos. 37017/1976 and 42744/1980. The preparation of the polymer complex will be briefly described. The basic polymer and the styrene/(meth)acrylic acid copolymer may be dissolved in and mixed with a solvent which can dissolve the basic polymer and the styrene/(meth)acrylic acid copolymer per se but cannot dissolve a polymer copolymer (e.g., water, an alcohol, an ester, or a hydrocarbon), followed by recovery of the resultant polymer complex. Further, since the polymer complex is well dissolved in a dimethylformamide, dimethylacetamide, dimethylsulfoxide, cellosolve or other solvent, a polymer complex solution can be prepared by dissolving the basic polymer and the styrene/(meth)acrylic acid copolymer in such a solvent and mixing them together. The solvent is more preferably a cellosolve solvent.

The ink receptive layer of the recording medium according to the present invention may further contain other polymer(s) in addition to the above polymer complex. Other polymers usable herein include naturally occurring resins, such as albumin, gelatin, casein, starch, cation starch, gum arabic, and sodium alginate, and synthetic resins, such as polyvinyl alcohol, polyamide, polyacrylamide, quaternized polyvinyl pyrrolidone, polyethylene imine, polyvinyl pyridylium halide, melamine resin, polyurethane, polyester, and sodium polyacrylate. They may be used alone or as a mixture of two or more.

Further, in order to improve the strength of the ink-absorbent layer and the adhesion of the ink-absorbent layer to the substrate, the ink-absorbent layer may further contain a resin, examples of which include SBR latex, NBR latex, polyvinyl formal, polymethyl methacrylate, polyvinyl butyral, polyacrylonitrile, polyvinyl chloride, polyvinyl acetate, phenolic resin, and alkyd resin.

Furthermore, according to a preferred embodiment of the present invention, various fillers, for example, silica, clay, talc, diatomaceous earth, calcium carbonate, calcium sulfate, barium sulfate, aluminum silicate, synthetic zeolite, alumina, zinc oxide, lithopone, and satin white, may be dispersed in the ink-absorbent layer for enhancing the ink absorption of the ink-absorbent layer.

The substrate of the recording medium according to the present invention may not be particularly limited so far as it can support the ink-absorbent layer and has sufficient strength as a recording medium. It may be either transparent or opaque. Opaque substrates usable herein include cloth, wood, sheet metal, and paper. Further, substrates prepared by opacifying the following transparent substrates may also be used. Transparent substrates usable herein include, for example, films or sheets of polyester resins, diacetate resins, triacetate resins, acrylic resins, polycarbonate resins, polyvinyl chloride, polyimide resins, cellophane, and celluloid; and glass sheets.

The ink-absorbent layer of the recording medium according to the present invention may be formed by coating a composition containing the above polymer complex and optional other components onto the substrate to form a film. Specifically, it may be formed by dissolving or dispersing the above complex and optional other components in a suitable solvent to prepare a coating composition, coating the coating composition onto the substrate, for example, by roll coating, bar coating, spray coating, air knife coating, gravure coating, reverse coating, pipe coating, Komma coating or the like, and drying the coating. Alternatively, a mixture containing the polymer complex and optional other components may be coated by hot melt coating onto the substrate to form an ink-absorbent layer. Further, a film of such a mixture may be provided and then laminated onto the above substrate to form an ink-absorbent layer.

According to a preferred embodiment of the present invention, the thickness of the ink-absorbent layer may be about 2 to 20 μm with a thickness of about 3 to 10 μm being more preferred.

In jet recording method and ink composition

The recording medium according to the present invention is suitable for recording methods using an ink composition, especially for ink jet recording.

According to a preferred embodiment of the present invention, the recording medium of the present invention is used in combination with an ink composition which basically comprises a colorant, a thermoplastic resin, and water.

According to a further preferred embodiment of the present invention, the recording medium of the present invention and a specific ink composition are provided, and printing is performed by ink jet recording involving the step of heating the recording medium after printing.

The thermoplastic resin contained in the ink composition used in the preferred embodiment of the present invention is a thermoplastic resin having a softening or heat melting temperature of 50° to 150° C., preferably 60° to 100° C. The term "softening temperature" or "melting temperature" used herein refers to the lowest temperature among the glass transition temperature, melting point, a temperature at which the viscosity coefficient is $10^{11}$ to $10^{12}$ poises, and fluidized point of the thermoplastic resin. More specifically, the softening point of the thermoplastic resin refers to the lowest temperature among the softening point, glass transition temperature (T9), melting point, and, when the thermoplastic resin is in an emulsion form, the minimum film forming temperature (MFT).

The amount of the thermoplastic resin added is preferably about 5 to 40% by weight, more preferably about 5 to 25% by weight, based on the whole ink.

Further, the above resin is preferably such that ot, when dried under room temperature environment, does not form a film but a solid or a fragile solid matter and, when heated at the softening or melting temperature or above and then cooled, forms a strong, water-resistant film.

Specific examples of water-insoluble thermoplastic resins usable herein include, but not limited to, polyacrylic acid, polymethacrylic acid, a polymethacrylic ester, polyethylacrylic acid, a styrene/butadiene copolymer, a butadiene copolymer, an acrylonitrile/butadiene copolymer, a chloroprene copolymer, a crosslinked acrylic resin, a crosslinked styrene resin, a fluororesin, polyvinylidene fluoride, benzoguanamine resin, phenolic resin, a polyolefin resin, cellulose, a styrene/acrylic ester copolymer, a styrene/methacrylic ester copolymer, polystyrene, a styrene/acrylamide copolymer, poly-n-isobutyl acrylate, polyacrylonitrile, polyvyinyl acetate, polyacrylamide, a silicone resin, polyvinyl acetal, polyamide, a rosin resin, polyethylene, a polycarbonate, a polyvinylidene chloride resin, a cellulosic resin, an epoxy resin, a vinyl acetate resin, an ethylene/vinyl acetate copolymer, a vinyl acetate/(meth) acrylate copolymer, a vinyl chloride resin, polyurethane, and a rosin ester.

Specific examples of low-molecular weight thermoplastic resins include animal and vegetable waxes, such as polyethylene wax, montan wax, alcohol wax, synthetic oxide wax, an α-olefin/maleic anhydride copolymer, and carnauba wax, lanolin, paraffin wax, and microcrystalline wax.

Preferably, the above insoluble resin is added in such a form that only the resin is dispersed as a fine particle in the ink or in the form of such a resin emulsion that the resin is stably dispersed in water. The term "resin emulsion" used herein is intended to mean an emulsion comprising a continuous phase of water and a dispersed phase of the above resin component. This emulsion can be prepared by mixing the resin particles and optionally a surfactant with water. For example, an emulsion of an acrylic resin or a styrene/acrylic resin may be prepared by subjecting a (meth)acrylic ester or alternatively a (meth)acrylic ester in combination with styrene to dispersion polymerization in water optionally in the presence of a surfactant. The surfactant is not particularly limited, and preferred examples thereof include anionic surfactants. They may be used alone or as a mixture of two or more.

Known resin emulsions may also be used as the above resin emulsion. For example, resin emulsions described in Japanese Patent Publication No. 1426/1987 and Japanese Patent Laid-Open Nos. 56573/1991, 79678/1991, 160068/1991, and 18462/1992 as such may be used as the resin emulsion in the present invention.

Further, commercially available resin emulsions may also be used, and examples thereof include Microgel E-1002 and E-5002 (styrene/acrylic resin emulsion, manufactured by Nippon Paint Co., Ltd.), Voncoat 4001 (acrylic resin emulsion, manufactured by Dainippon Ink and Chemicals, Inc.), Voncoat 5454 (styrene/acrylic resin emulsion, manufactured by Dainippon Ink and Chemicals, Inc.), SAE1014 (styrene/acrylic resin emulsion, manufactured by Nippon Zeon Co., Ltd.), and Saivinol SK-200 (acrylic resin emulsion, manufactured by Saiden Chemical Industry Co., Ltd).

In the ink composition used in the present invention, a water-soluble thermoplastic resin may be used. Preferred resins usable herein include polyethylene oxide, hide glue, gelatin, casein, albumin, gum arabic, alginic acid, methyl cellulose, carboxymethyl cellulose, hydroxyethyl cellulose, and polyvinyl ether.

Pigments, water-soluble dyes, disperse dyes, and water-insoluble dyes (when kneaded with a resin emulsion and then added) may be used as the colorant. Any colorant may be used so far as it has good affinity for water as a main solvent or, when used in combination with a dispersant or the like, can be homogeneously dispersed.

Pigments usable herein include organic and inorganic pigments, and examples thereof for black ink compositions include carbon blacks (C.I. Pigment Black 7), such as furnace black, lamp black, acetylene black, and channel black, metals, such as copper, iron (C.I. Pigment Black 11), and titanium oxide, and organic pigments, such as aniline black (C.I. Pigment Black 1); and specific examples of pigments for color ink compositions include:

C.I. Pigment Yellow 1 (Fast Yellow G), 3, 12 (disazo yellow AAA), 13, and 14, 17, 24, 34, 35, 37, 42 (yellow iron oxide), 53, 55, 81, 83(disazo yellow HR), 95, 97, 98, 100, 101, 104, 108, 109, 110, 117, 120, 138, and 153, C.I. Pigment Orange 5, 13, 16, 17, 36, 43, and 51, C.I. Pigment Red 1, 2, 3, 5, 17, 22 (Brilliant Fast Scarlet), 23, 31, 38, 48:2 (Permanent Red 2B (Ba)), 48:2 (Permanent Red 2B (Ca)), 48:3 (Permanent Red 2B (Sr)), 48:4 (Permanent Red 2B (Mn)), 49:1, 52:2, 53:1, 57:1 (Brilliant Carmine 6B), 60:1, 63:1, 63:2, 64:1, 81 (Rhodamine 6G Lake), 83, 88, 101 (iron oxide red), 104, 105, 106, 108 (Cadmium Red), 112, 114, 122 (Quinacridone Magenta), 123, 146, 149, 166, 168, 170, 172, 177, 178, 179, 185, 190, 193, 209, and 219, C.I. Pigment Violet 1 (Rhodamine Lake), 3, 5:1, 16, 19 (Quinacridone Red), 23, and 38, C.I. Pigment Blue 1, 2, 15 (Phthalocyanine Blue R), 15:1, 15:2, 15:3 (Phthalocyanine Blue G), 15:4, 15:6 (Phthalocyanine Blue E), 16, 17:1, 56, 60, and 63, C.I. Pigment Green 1, 4, 7, 8, 10, 17, 18, and 36. Further pigments usable in the present invention include treated pigments which are pigments having a surface treated with a resin or the like, such as graft carbon.

The above water-insoluble colorant may be optionally used as a dispersion of a colorant which has been dispersed with the aid of a dispersant. Water-soluble dyes usable herein include direct dyes, acid dyes, basic dyes, and food dyes, and examples thereof include, but not limited to:

C.I. Direct Black 9, 17, 19, 22, 32, 51, 56, 62, 69, 77, 80, 91, 94, 97, 108, 112, 113, 114, 117, 118, 121, 122, 125, 132, 146, 154, 166, 168, 173, and 199;

C.I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, and 247;

C.I. Direct Violet 7, 9, 47, 48, 51, 66, 90, 93, 94, 95, 98, 100, and 101;

C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, and 163;

C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, and 291;

C.I. Acid Black 7, 24, 29, 48, 52: 1 and 172;

C.I. Acid Red 35, 42, 52, 57, 62, 80, 82, 111, 114, 118, 119, 127, 128, 131, 143, 151, 154, 158, 249, 254, 257, 261, 263, 266, 289, 299, 301, 305, 336, 337, 261, 396, and 397, C.I. Acid Violet 5, 34, 43, 47, 48, 90, 103, and 126;

C.I. Acid Yellow 17, 19, 23, 25, 39, 40, 42, 44, 49, 50, 61, 64, 76, 79, 110, 127, 135, 143, 151, 159, 169, 174, 190, 195, 196, 197, 199, 218, 219, 222, and 227;

C.I. Acid Blue 9, 25, 40, 41, 62, 72, 76, 78, 80, 82, 92, 106, 112, 113, 120, 127: 1, 129, 138, 143, 175, 181, 205, 207, 220, 221, 230, 232, 247, 258, 260, 264, 271, 277, 278, 279, 280, 288, 290, and 326;

C.I. Basic Black 8.

C.I. Basic Red 12, 13, 14, 15, 18, 22, 23, 24, 25, 27, 29, 35, 36, 38, 39, 45, and 46;

C.I. Basic Violet 1, 2, 3, 7, 10, 15, 16, 20, 21, 25, 27, 28, 35, 37, 39, 40, and 48;

C.I. Basic Yellow 1, 2, 4, 11, 13, 14, 15, 19, 21, 23, 24, 25, 28, 29, 32, 36, 39, and 40;

C.I. Basic Blue 1, 3, 5, 7, 9, 22, 26, 41, 45, 46, 47, 54, 57, 60, 62, 65, 66, 69, and 71;

C.I. Disperse Yellow 3, 5, 56, 60, 64, and 160;

C.I. Disperse Red 4, 5, 60, 72, 73, and 91;

C.I. Disperse Blue 3, 7, 56, 60, 79, and 198;

C.I. Disperse Orange 13 and 30; and

C.I. Food Black.

Examples of the water-insoluble dye used as a dispersion or as a mixture or solution in a resin include, but not limited to:

C.I. Solvent Black 3, 5, and 22;

C.I. Solvent Yellow 19, 44, 98, 104, 105, 112, 113, and 114;

C.I. Solvent Red 8, 24, 71, 109, 152, 155, 176, 177, and 179;

C.I. Solvent Blue 2, 11, 25, 78, 94, and 95;

C.I. Solvent Green 26;

C.I. Solvent Orange 5, 40, 45, 72, 63, 68, and 78; and

C.I. Solvent Violet 13, 31, 32, and 33.

The amount of the dye added may be determined depending upon the kind of the dye, the kind of the solvent, properties required of the ink and the like. It, however, is preferably about 0.2 to 10% by weight, more preferably about 0.5 to 5% by weight.

The ink composition used in the present invention may comprises, besides water, an organic solvent as a solvent. Specific examples of preferred organic solvents include high-volatile monohydric alcohols such as ethanol, propanol, isopropanol, and butanol. Further, hydrophilic, high-boiling, low-volatile organic solvents may be added from the viewpoint of preventing clogging of nozzles and improving moisture retention of the ink composition. Specific examples of preferred hydrophilic, high-boiling, low-volatile organic solvents include polyhydric alcohols, such as glycerin, ethylene glycol, diethylene glycol, triethylene glycol, propylene glycol, dipropylene glycol, hexylene glycol, polyethylene glycol, and polypropylene glycol and monoetherification products, dietherification products, and esterification products thereof, for example, ethylene glycol monomethyl ether, ethylene glycol monoethyl ether, ethylene glycol monobutyl ether, diethylene glycol monomethyl ether, and diethylene glycol monobutyl ether. Further, nitrogen-containing organic solvents, for example, N-methyl-2-pyrrolidone, 1,3-dimethyl imidazolidinone, monoethanolamine, N,N-dimethylethanolamine, N,N-diethylethanolamine, diethanolamine, N-n-butyldiethanolamine, triisopropanolamine, and triethanolamine may also be used.

According to a preferred embodiment of the present invention, the ink composition further comprises a water-soluble polymer. The amount of the water-soluble polymer added is preferably 1:10 to 1 in terms of the weight ratio of the water-soluble polymer to the thermoplastic resin in the ink composition. Specific examples of preferred water-soluble polymers include polyalkyl oxides, such as polyethylene oxide, polyvinyl pyrrolidone, polyvinyl alcohol, polyvinyl butyral, polyacrylic acid, hide glue, gelatin, casein, albumin, gum arabic, alginic acid, methyl cellulose, carboxymethyl cellulose, hydroxyethyl cellulose, polyvinyl ether, polyvinyl methyl ether, and polyethylene glycol.

According to a preferred embodiment of the present invention, the ink composition further comprises a saccharide. The amount of the saccharide added is preferably 1:5 to 1 in terms of the weight ratio of the saccharide to the thermoplastic resin in the ink composition. Specific examples of preferred saccharides include monosaccharides, disaccharides, polysaccharides, and glycosides, such as α-cyclodextrin, glucose, xylose, sucrose, maltose, arabinose, maltitol, and starch.

If necessary, suitable additives may be added to the ink composition used in the present invention for improving various properties. Specific examples of additives usable herein include viscosity modifiers, surface tension modifiers, pH adjustors, fungicides, and preservatives. Specifically, at least one member selected from water-soluble anionic, cationic, amphoteric, and nonionic surfactants may be added in order to modify the surface tension of the ink and to regulate the diameter of dots on a recording paper. Further, pH adjustors, such as potassium dihydrogenphosphate and sodium dihydrogenphosphate, and fungicides, preservatives, and rust preventives, such as benzoic acid, dichlorophene, hexachlorophene, sorbic acid, p-hydroxy benzoic esters, ethylenediamintetraacetic acid (EDTA), sodium dehydroacetate, 1,2-benzothiazoline-3-one (trade name: Proxel XL II, manufactured by ICI), and 3,4-isothiazoline-3-one, may be added to the ink composition. Further, urea, thiourea, ethylene urea and the like may be added from the viewpoint of preventing hozzles from drying.

According to a preferred embodiment of the present invention, the ink composition used in the present invention is preferably such that the thermoplastic resin is in a resin emulsion form and, when a saccharide is further contained, the ink composition contains a nonionic surfactant having a polyoxyethylene group. The addition of the nonionic surfactant can impart excellent water resistance, friction resistance, marker resistance, and water resistance to prints.

The amount of the nonionic surfactant added is preferably 0.05 to 10% by weight based on the ink composition. When the nonionic surfactant is present, the weight ratio of the solid content of the resin emulsion to the saccharide in the ink composition is preferably in the range of from 3:1 to 1:1.

According to a preferred embodiment of the present invention, the nonionic surfactant having a polyoxyethylene group has an HLB (hydro-lipophile balance) of not less than 13.

Preferred examples of nonionic surfactants having a polyoxyethylene group include acetylene glycol, alcohol ethylene oxide, polyoxyethylene alkyl ether, polyoxyethylene alkylphenyl ether, polyoxyethylene polystilphenyl ether, polyoxyethylene polyoxypropylene glycol, polyoxyethylene-polyol propylenealkyl ether, polyoxyethylene polyhydric alcohol fatty acid partial ester, polyoxyethylene fatty acid ester, polyglycerin fatty acid ester, polyoxyethylenated castor oil, polyoxyethylene alkylamine, and polyoxyethylene sorbitan fatty acid ester. Among them, polyoxyethylene sorbitan polyhydric alcohol fatty acid partial ester and polyoxyethylene sorbitan fatty acid ester are preferred from the viewpoint of fastness.

According to a preferred embodiment of the present invention, the ink composition of the present invention, when the thermoplastic resin is in a resin emulsion form, comprises an anionic surfactant having a polyoxyethylene group. The addition of the anionic surfactant can offer excellent ejection stability and friction resistance and water resistance of the print.

The amount of the anionic surfactant added is preferably such that the weight ratio of the solid content of the resin emulsion to the anionic surfactant is 1:0.001 to 1:0.5, that is, 1000:1 to 2:1.

Preferred examples of the anionic surfactants having a polyoxyethylene group include salts of polyoxyethylene alkyl ether sulfuric acids, salts of polyoxyethylene alkylphenyl ether sulfuric acids, salts of polyoxyethylene styrenated phenyl ether sulfuric acids, salts of polyoxyethylene alkyl ether phosphoric acids, and salts of polyoxyethylene alkyl phenyl ether phosphoric acids. Salts of polyoxyethylene alkyl ether sulfuric acids and salts of polyoxyethylene alkylphenyl ether sulfuric acids are particularly preferred. Examples of preferred salts include potassium salt, sodium salt, ammonium salt, and salt with monoethanolamine, particularly salt with ethanolamine. Among them, an ammonium salt is particularly preferred. According to a preferred embodiment of the present invention, the degree of polymerization of the polyoxyethylene group is preferably about 3 to 10, and the alkyl group preferably has about 1 to 17 carbon atoms. Further, according to a preferred embodiment of the present invention, the ink composition used in the present invention, when the thermoplastic resin is in a resin emulsion form, contains an organic acid. The addition of the organic acid can impart excellent friction resistance and water resistance to prints. Preferred organic acids include amino acids and salts and derivatives thereof, and specific examples thereof include L-ascorbic acid, D-isoascorbic acid (L-sorbic acid), and glycine. The amount of the organic acid added is preferably about 0.01 to 0.5% by weight based on the ink composition.

Various properties of the ink may be properly regulated. According to a preferred embodiment of the present invention, the viscosity of the ink composition is preferably not more than 50 mPa.sec, more preferably not more than 25 mPa.sec. When the viscosity falls within the above range, the ink composition can be stably ejected from the recording head. The surface tension of the ink composition also may be suitably determined. In the case of multi-color printing, however, the surface tension of the color ink composition is preferably 30 to 50 mN/m (25° C.).

The ink jet recording method according to the present invention can be performed as follows. In the first step, droplets of the ink composition are ejected to form an ink image on a recording medium. According to the present invention, the recording medium with the ink deposited thereon is then heated. Preferably, the heating is performed at the softening temperature of the thermoplastic resin or above.

Although the "softening temperature of the thermoplastic resin or above" varies depending upon the thermoplastic resin used, it is generally in the range of from 50° to 120° C. According to a more preferred embodiment of the present invention, it is about 65° to 100° C. The heating may be initiated after the deposition of the ink droplet. Alternatively, the ink droplet may be deposited onto a preheated recording medium.

An ink jet recording apparatus which may be preferably used in the practice of the ink jet recording method will be described with reference to the accompanying drawing.

FIG. 1 is an ink jet recording apparatus according to the present invention. In the drawing, a recording medium 1 is fed from a sheet feeding tray 2. A platen 4 functions as means for heating the recording medium and also as means for carrying the recording medium. The platen 4 is in the form of a cylinder made of a metal having high heat conductivity, for example, aluminum, and is rotated by a drive means 6 in a direction indicated by an arrow shown in the drawing. A silicone rubber or the like may be laminated on the surface of the platen 4. A heater 7 is placed in the platen 4 to heat the platen 4. An ink jet recording head 3 is disposed at a position opposite to the platen 4 with the recording medium 1 sandwiched between platen 4 and the ink recording head 3. The recording head 3 forms droplets by taking advantage of either a piezoelectric element or thermal energy. Preferably, for example, 48 nozzles are arranged in a suitable matrix in the recording head 3. The nozzles of the recording head 3 eject ink droplets based on printing data given by a computing unit not shown. An ink composition is fed from an ink tank 10 into the recording head 3, and the recording head 3, together with a carriage 5 driven by a recording head drive 11, is movable in a direction perpendicular to the recording medium feed direction.

Ink jet recording is performed as follows. First, the recording medium 1 being carried comes into contact with the platen 4 heated by the heater 7, permitting the recording medium 1 to be heated. Therefore, in the apparatus according to this embodiment, the temperature of the surface of the platen 4 is preferably regulated in such a manner that the temperature of the recording medium 1 is brought to the softening temperature of the thermoplastic resin or above. Ink droplets are then selectively ejected according to a print pattern by the recording head 3 onto the carried recording medium 1. The droplets deposited onto the recording medium are heated to form ink dots.

The heating of the recording medium may be of non-contact type. Specifically, the recording medium may be heated by irradiation with heat rays or by blowing hot air against it. In the above apparatus, the drive frequency and the carriage speed of the recording head may be suitably determined. They, however, are preferably about 3 to 15 kHz and about 100 to 1200 mm/sec, respectively.

EXAMPLES

The present invention will be described in more detail with reference to the following examples, though it is not limited to these examples only.

Preparation of OHP sheet (1)

A 10% polyvinyl pyrrolidone (tarde name: PVP K-90, manufactured by GAF, solvent: ethanol/methanol/ethyl cellosolve mixture) was mixed, in a weight ratio specified in Table 2, with a solution prepared by diluting a styrene/acrylic acid copolymer (trade name: AST-7022 manufactured by Nippon Shokubai Kagaku Kogyo Co., Ltd., effective component 50–55%) with ethyl cellosolve to 10% of the effective component, thereby preparing coating compositions.

The coating compositions were coated on a 100 μm-thick light transmissive polyethylene terephthalate (PET) by means of a bar coater at a coverage of 3 μm when dried, and the coatings were dried at 140° C. for 3 min, thereby preparing OHP sheets.

Preparation of ink compositions

Ink compositions listed in the following Table 1 were prepared by a conventional method.

TABLE 1

| | Example | | | |
|---|---|---|---|---|
| | Black | Cyan | Yellow | Magenta |
| Colorant: | | | | |
| Carbon black | 1.5 | | | |
| C.I. Pigment Blue 15 | | 1.5 | | |
| C.I. Acid Yellow 23 | | | 1.5 | |

TABLE 1-continued

| | Example | | | |
|---|---|---|---|---|
| | Black | Cyan | Yellow | Magenta |
| C.I. Direct Red 92 | | | | 1.5 |
| Thermoplastic resin: | | | | |
| Acrylic ester/styrene copolymer emulsion (MFT 82° C.) | 15.0 | 15.0 | 15.0 | 15.0 |
| Maltitol | 10.0 | 7.0 | 7.0 | 7.0 |
| Nonionic surfactant: | | | | |
| Acetylene glycol alcohol ethylene oxide | 0.1 | 0.1 | 0.1 | |
| Anionic surfactant: | | | | |
| Polyoxyethylene alkylphenyl ether sulfuric acid, ammonium salt | 0.3 | 0.3 | 0.3 | 0.3 |
| Diethylene glycol | 3.0 | 12.0 | 12.0 | 12.0 |
| Water | Balance | Balance | Balance | Balance |

Test on evaluation of print

An ink jet recording device shown in FIG. 1 was used to print the above ink compositions on the above OHP sheets. Heating of the recording media was conducted by regulating the temperature of a platen so as to bring the temperature of the recording medium to 100° C..

Prints were evaluated as follows. In the following evaluation, ⊙, ○ and Δ means that the recording medium is acceptable from the practical viewpoint, while X means that the recording medium is unacceptable from the practical viewpoint.

Cracking of print

Whether or not printed image cracks in a period between immediately after printing and about 5 min after printing was visually inspected. The results were evaluated according to the following criteria and are shown in Table 2.

○: No cracks was observed.

Δ: Cracks were observed 100% duty printed area.

X: Cracks were observed also in not more than 70% duty printed area.

Whitening of print

Whether or not the surface of the printed image suffered from whitening was visually inspected. The results were evaluated according to the following criteria and are shown in Table 2.

⊙: No whitening was observed.

○: Slight whitening was observed.

X: Considerable whitening was observed.

Light transmission (haze)

The haze defined as the proportion of scattered light (Hd) in total transmitted light (Ht) was measured with a turbidimeter (NDH-1001DP, manufactured by Nippon Denshoku Co., Ltd.). The measurements were evaluated according to the following criteria. The results were as given in Table 2.

⊙: A haze of not more than 10

○: A haze of 11 to 15

Δ: A haze of 16 to 20

X: A haze of not less than 21

TABLE 2

| OHP No. | P/S ratio | Results of evaluation: Cracks | Whitening | Haze |
|---|---|---|---|---|
| 1 | 10:2 | x | ⊙ | ○ (12) |
| 2 | 10:3 | x | ⊙ | ⊙ (7) |
| 3 | 10:3.5 | ○ | ⊙ | ⊙ (7) |
| 4 | 10:4 | ○ | ⊙ | ⊙ (7) |
| 5 | 10:4.5 | ○ | ⊙ | ⊙ (7) |
| 6 | 10:5 | ○ | ○ | ○ (11) |
| 7 | 10:6 | ○ | ○ | ○ (12) |
| 8 | 10:7 | ○ | ○ | ○ (13) |
| 9 | 10:8 | ○ | x | Δ (16) |
| 10 | 10:10 | ○ | x | Δ (17) |

Preparation of OHP sheet (2)

OHP sheets were prepared in the same manner as described above in connection with the preparation of OHP sheets (1), except that the P/S value was 4.5 and the thickness was brought to 1.5 to 6.0 μm as indicated in Table 3.

OHP sheets thus prepared were subjected to a print evaluation test. The results were as shown in Table 3.

TABLE 3

| OHP No. | Coating thickness (μm) | Results of evaluation: Cracks | Whitening | Haze |
|---|---|---|---|---|
| 11 | 6 | ○ | ⊙ | ⊙ (7) |
| 12 | 4.5 | ○ | ⊙ | ⊙ (7) |
| 13 | 3 | ○ | ⊙ | ⊙ (7) |
| 14 | 2 | ○ | ⊙ | ⊙ (8) |
| 15 | 1.5 | x | x | Δ (16) |

What is claimed is:

1. A recording medium comprising a substrate and an ink-absorbent layer provided on at least one side of the substrate, the ink-absorbent layer being formed of a polymer complex of a basic polymer and a styrene/(meth)acrylic acid polymer, the mixing ratio of the basic polymer and the styrene/(meth)acrylic acid polymer being in the range of from 10:3.5 to 7.

2. The recording medium according to claim 1, which is used for ink jet recording.

3. An ink jet recording method comprising the steps of:

ejecting droplets of an ink composition comprising at least a colorant, a thermoplastic resin, and water onto a recording medium according to claim 2, to deposit the ink droplets onto the recording medium; and heating the recording medium with the ink droplets deposited thereonto.

4. The recording medium according to claim 1, wherein the base material is a transparent OHP sheet.

5. An ink jet recording method comprising the steps of:

ejecting droplets of an ink composition comprising at least a colorant, a thermoplastic resin, and water onto a recording medium according to claim 4, to deposit the ink droplets onto the recording medium; and heating the recording medium with the ink droplets deposited thereonto.

6. The recording medium according to claim 1, wherein the basic polymer is polyvinyl pyrrolidone.

7. An ink jet recording method comprising the steps of:

ejecting droplets of an ink composition comprising at least a colorant, a thermoplastic resin, and water onto a recording medium according to claim 6, to deposit the ink droplets onto the recording medium; and heating the recording medium with the ink droplets deposited thereonto.

8. The recording medium according to claim 1, wherein the ink-absorbent layer has a thickness of 2 to 20 μm.

9. An ink jet recording method comprising the steps of:

ejecting droplets of an ink composition comprising at least a colorant, a thermoplastic resin, and water onto a recording medium according to claim 8, to deposit the ink droplets onto the recording medium; and heating the recording medium with the ink droplets deposited thereonto.

10. An ink jet recording method comprising the steps of: ejecting droplets of an ink composition comprising at least a colorant, a thermoplastic resin, and water onto a recording medium according to claims 1 to deposit the ink droplets onto the recording medium; and heating the recording medium with the ink droplets deposited thereonto.

11. The ink jet recording method according to claim 10, wherein the heating is performed at the softening temperature of the thermoplastic resin or above.

* * * * *